US006488529B1

(12) United States Patent
Chen

(10) Patent No.: US 6,488,529 B1
(45) Date of Patent: Dec. 3, 2002

(54) SOCKET CONNECTOR ASSEMBLY USED IN A LAN

(75) Inventor: Pin-Hung Chen, NEPZ Kaohsiung (TW)

(73) Assignee: Taimag Corporation, NEPZ Kaohsiung (TW)

( * ) Notice: Subject to any disclaimer, the term of this patent is extended or adjusted under 35 U.S.C. 154(b) by 0 days.

(21) Appl. No.: 10/054,402

(22) Filed: Jan. 22, 2002

(51) Int. Cl.[7] ..... H01R 3/00

(52) U.S. Cl. ..... 439/490; 439/676; 439/56; 439/591; 439/541.5; 439/540.1; 439/936

(58) Field of Search ..... 439/490, 676, 439/56, 489, 591, 541.5, 876, 59, 68, 76.1, 276, 936, 540.1; 362/800

(56) References Cited

U.S. PATENT DOCUMENTS 5,577,937 A * 11/1996 Itoh et al. ..... 439/620
5,797,767 A * 8/1998 Schell ..... 439/490
5,815,072 A * 9/1998 Yamanaka et al. ..... 340/461
5,876,240 A * 3/1999 Derstine et al. ..... 439/490
6,159,039 A * 12/2000 Wu ..... 439/541.5
6,352,446 B2 * 3/2002 Ezawa et al. ..... 439/490
6,390,854 B2 * 5/2002 Yamamoto et al. ..... 439/620
6,416,364 B1 * 7/2002 Shi et al. ..... 439/680
6,422,657 B2 * 7/2002 Tomomatsu ..... 34/77
6,428,361 B1 * 8/2002 Imschweiler et al. ..... 439/676

* cited by examiner

*Primary Examiner*—P. Austin Bradley
*Assistant Examiner*—Truc Nguyen
(74) *Attorney, Agent, or Firm*—Alan D. Kamrath; Rider, Bennett, Egan & Arundel

(57) ABSTRACT

A connector assembly consisting of a dielectric housing having at least one socket cavity defined in a front end thereof and a fixing recess defined at one outer side surface of the housing, a PCB securely fixed in the fixing recess by a sealing resin, and at least one indicator fixedly embedded in the sealing resin and secured between an inner side of the PCB and a bottom of the fixing recess, wherein the fixing recess is defined with a front opening at a front end thereof, therefore the at least one indicator emit light from the front opening of the fixing recess.

3 Claims, 6 Drawing Sheets

SOCKET CONNECTOR ASSEMBLY USED IN A LAN

BACKGROUND OF THE INVENTION

1. Field of the Invention

The present invention relates to a socket connector assembly having at least one indicator secured between a PCB and a fixing recess defined at one outer side surface of a dielectric housing.

2. Description of Related Art

The RJ45 connector has become a standard type socket connector used in the local area network (LAN) to connect computers and servers together. As shown in FIG. 7, a conventional assembly (7) comprises a dielectric housing (70) with stacked different types of socket (71) defined in a front end thereof and two fixing holes (72) defined at opposite sides in the front end thereof, a PCB (80) having a bracket (81) extending horizontally therefrom, an inner contact portion (82) arranged along the bracket (81), and two indicators (83) disposed according to the two fixing hole (72) and electrically connected with the PCB (80) via terminal pins (84). The PCB (80) is assembled on a rear end of the housing (70), the contact portion (81) is correspondingly extended into the socket (71) of the housing (70), and the indicators (83) are respectively inserted from rear end openings into the fixing holes (72).

It can be appreciated that because the terminal pins (84) are particularly long, obstructions are often produced in the fixing holes (72) when the indicators (83) and terminal pins (84) are inserted from the rear openings into the fixing holes (72), so that the acceptable rate of manufacturing of the conventional connector assembly (7) is low.

Therefore, it is an objective of the invention to provide an improved socket connector assembly to mitigate and/or obviate the aforementioned problems.

SUMMARY OF THE INVENTION

The main object of the present invention is to provide a socket connector assembly having a dielectric housing with a fixing recess defined at one outer side surface thereof to receive a PCB securely fixed therein by a sealing resin, and at least one indicator secured between the PCB and the fixing recess. Whereby the indicator is easily assembled on the socket connector assembly, and the acceptable rate of the manufacturing of the connector assembly is therefore improved.

Other objects, advantages and novel features of the invention will become more apparent from the following detailed description when taken in conjunction with the accompanying drawings.

DETAILED DESCRIPTION OF THE PREFERRED EMBODIMENT

Figure 1:
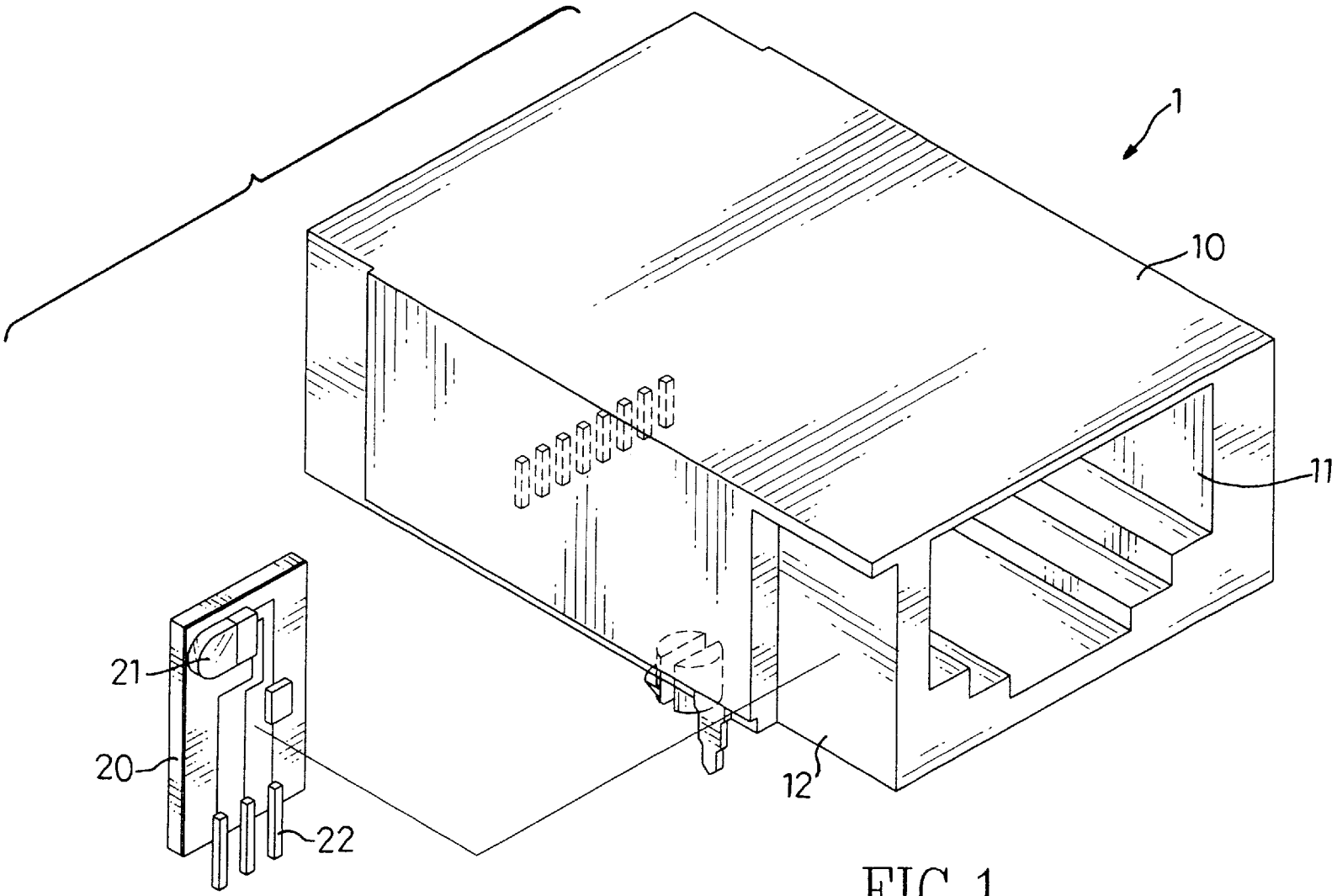
FIG. 1 is an exploded perspective view of a first embodiment of the invention, showing a single-socket connector assembly.
Figure 2:
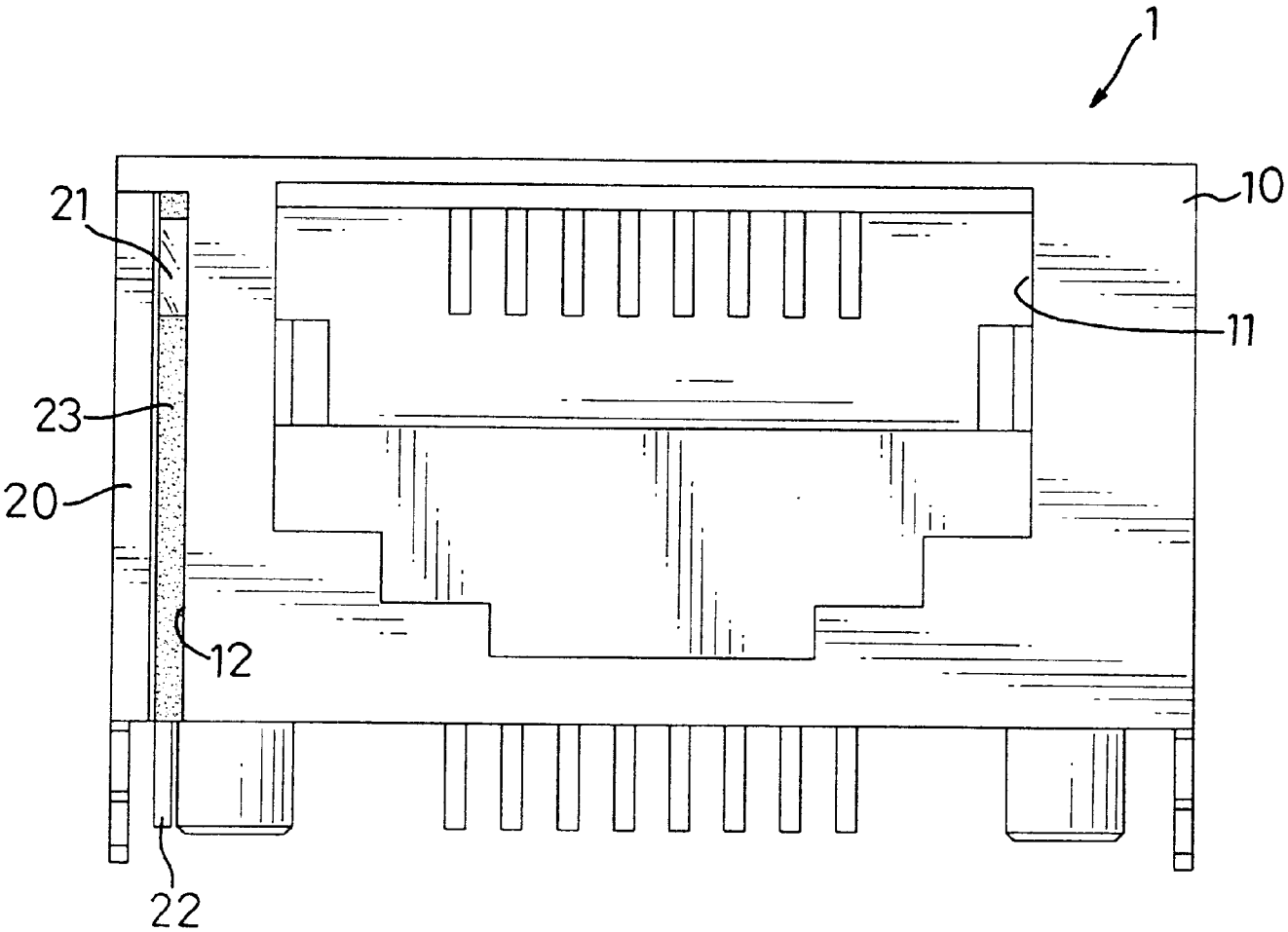
FIG. 2 is a front view of the first embodiment of the connector assembly in accordance with the invention.

Referring to FIGS. 1 and 2, in a first embodiment of the invention a socket connector assembly (1) comprises a main dielectric housing (10) having a standard RJ45 socket cavity (11) defined in a front end thereof, and a fixing recess (12) defined at one outer side surface of the housing (10) for receiving a PCB (20) fixed therein. Wherein the fixing recess (12) has a front opening defined at a front end thereof.

An indicator (21) with a contact portion (22) is mounted on an inner side of the PCB (20). When the inner side of the PCB (20) is securely adhered on a bottom surface of the fixing recess (12) by a sealing resin (23), an outer side surface of the PCB (20) is flush with the outer side surface of the housing (10), and the indicator (21) embedded in the sealing resin (23) is secured between the inner side of the PCB (20) and the bottom surface of the fixing recess (12). Because the fixing recess (12) has the front opening defined at the front end thereof, the indicator (21) emits lightthrough the front opening of the fixing recess (12).

Figure 3:
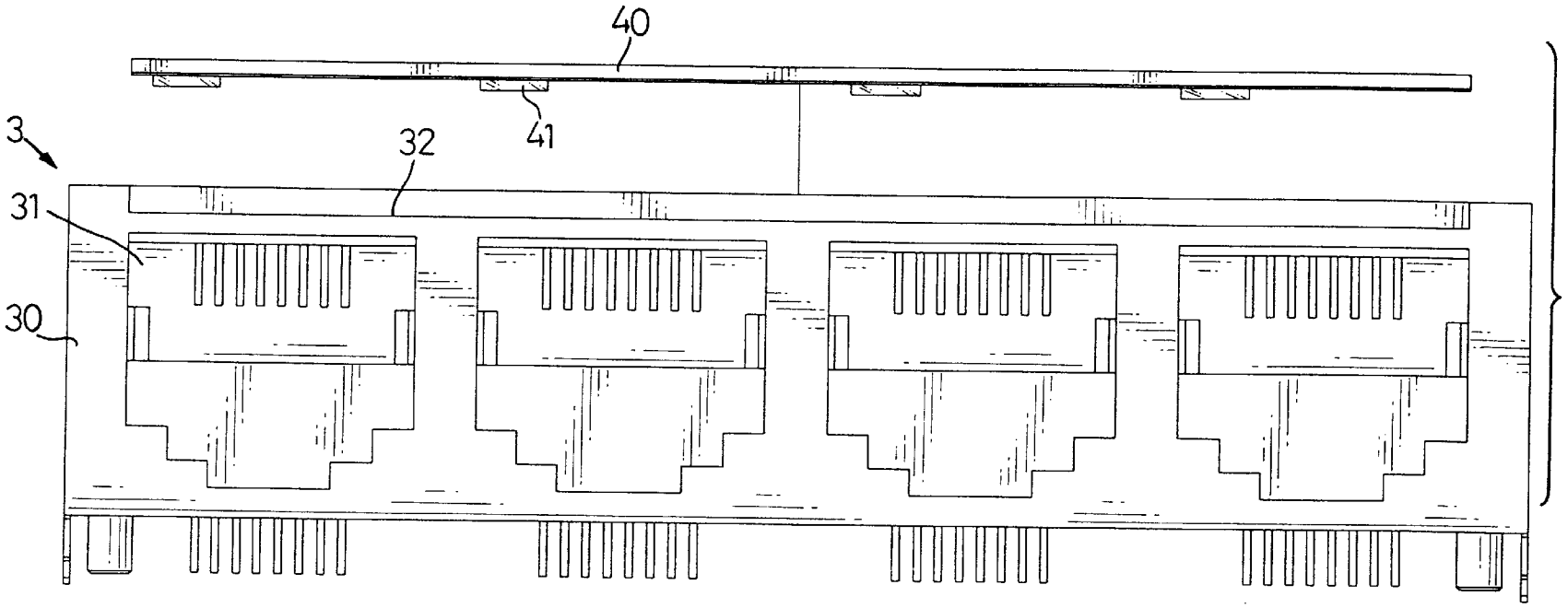
FIG. 3 is a schematic front view of a second embodiment of the connector assembly in accordance with the invention.
Figure 5:
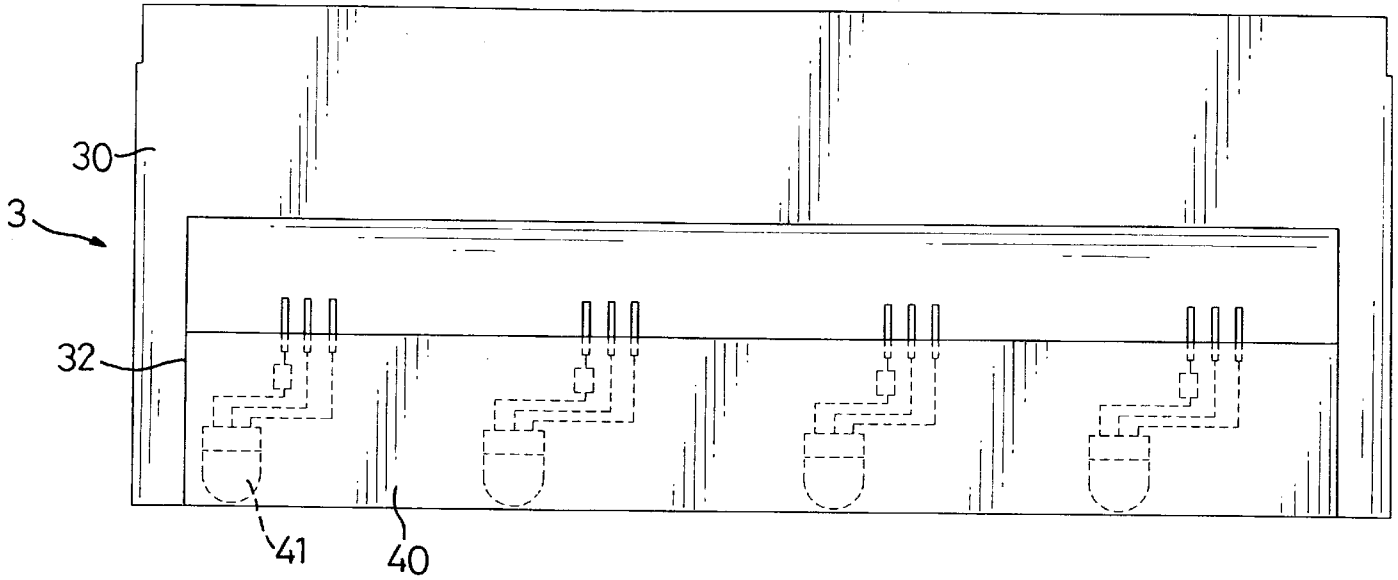
FIG. 5 is a top view of the second embodiment of the connector assembly in accordance with the invention.
Figure 4:
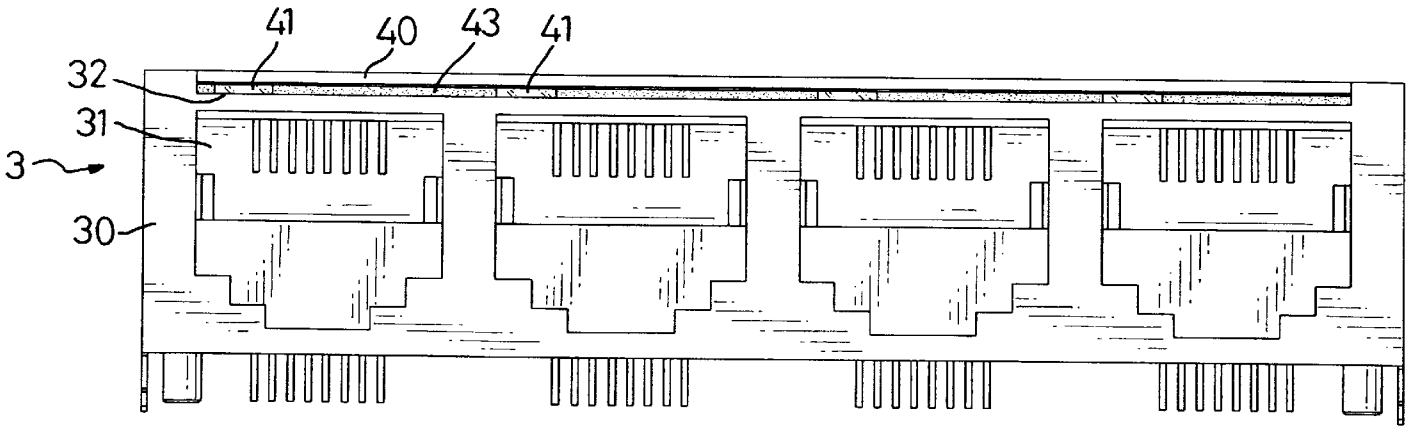
FIG. 4 is a front view of the second embodiment of the connector assembly in accordance with the invention.

With reference to FIGS. 3 to 5, a second embodiment of a connector assembly (3) comprises a dielectric housing (30) with multiple RJ45 type socket cavities (31) defined in a front end thereof and a fixing recess (32) defined on a top surface thereof to receive a PCB (40) fixed therein. Wherein the fixing recess (32) has a front opening defined at a front end thereof.

Multiple indicators (41) are securely mounted on an inner side of the PCB (40). When the PCB (40) is securely adhered on the bottom of the fixing recess (32) by a sealing resin (43). The indicators (41) are embedded in the sealing resin (43) and secured between the inner side of the PCB (40) and the bottom of the fixing recess (32), therefore the indicators (41) emit light from the front opening of the fixing recess (32).

Figure 6:
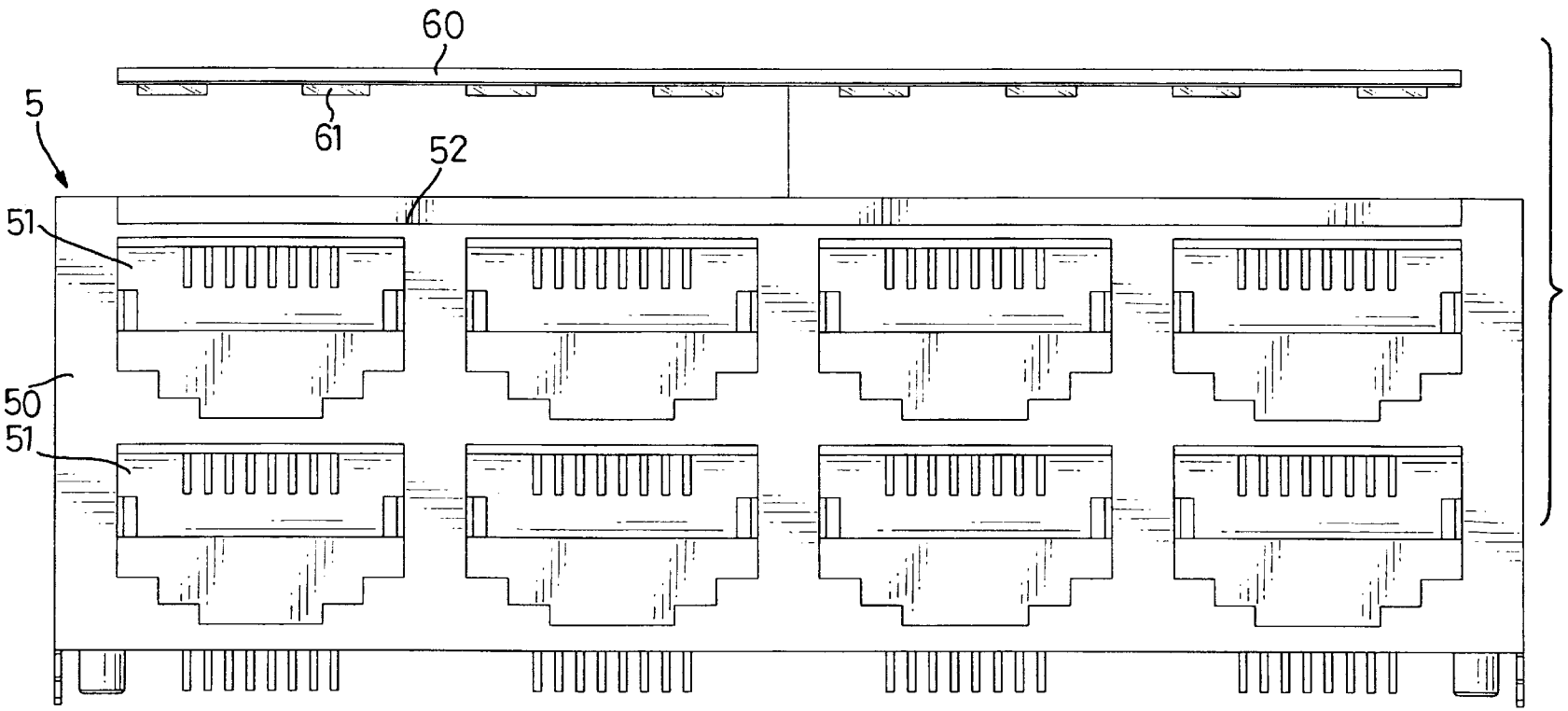
FIG. 6 is a schematic front view of a third embodiment of the connector assembly in accordance with the invention.
Figure 7:
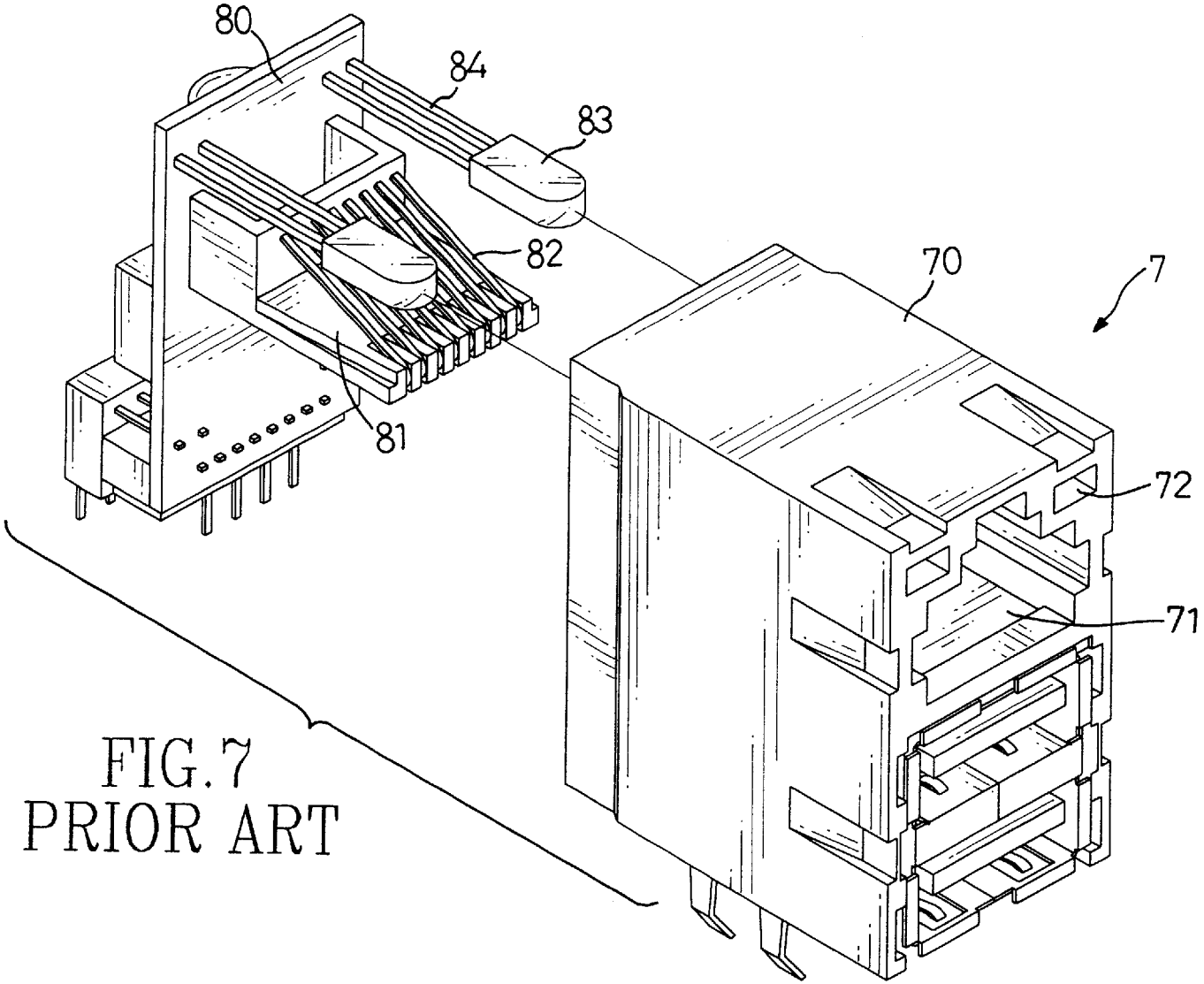
FIG. 7 PRIOR ART
FIG. 7 is an exploded perspective of a conventional connector assembly.

As shown in FIG. 6, in a third embodiment of the invention, a connector assembly (5) has a dielectric main housing (50) with stacked RJ45 type sockets cavities (51) defined in a front end thereof and a fixing recess (52) defined on a top surface thereof for receiving a PCB (60) fixed therein. Wherein the fixing recess (52) has a front opening defined at a front end thereof.

Multiple indicators (61) are secured on an inner side of the PCB (60). When the PCB (60) is fixedly adhered on a bottom surface of the fixing recess (52) by a sealing resin (not numbered), the indicators (61) are embedded in the sealing resin and fixedly secured between the inner side of the PCB (60) and the bottom of the fixing recess (52) and emit light from the front opening of the fixing recess (52).

The advantage of the connector assembly of the invention is that because of the structure of the connector assembly, the indicators are easily assembled on the housing, therefore the defect rate of manufacturing of the connector assembly is low.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector assembly consisting of a dielectric housing having at least one socket cavity defined in a front end thereof and a fixing recess defined at one outer side surface of the housing, a PCB securely fixed in the fixing recess by a sealing resin, and at least one indicator embedded in the sealing resin and fixedly secured between an inner side of the PCB and a bottom of the fixing recess, wherein the fixing recess has a front opening defined at a front end thereof, therefore the at least one indicator emits light from the front opening of the fixing recess.

2. The connector assembly as claimed in claim 1, wherein the fixing recess is defined at one side surface of the housing.

3. The connector assembly as claimed in claim 1, wherein the fixing recess is defined at a top surface of the housing.

* * * * *